US005375665A

United States Patent [19]

Fanchang et al.

[11] Patent Number: 5,375,665

[45] Date of Patent: Dec. 27, 1994

[54] MOTORIZED DRIVING TOOL

[76] Inventors: Wei-Chuan Fanchang, 19, Lane 11, Chang Pyng Road, Section 2; Hsueh-Wei Hsueh, 19, Lane 11, Chang Pyng Road Section 2, both of Taichung, Taiwan, Prov. of China

[21] Appl. No.: 205,373

[22] Filed: Mar. 4, 1994

[51] Int. Cl.[5] ..... B25D 11/00

[52] U.S. Cl. ..... 173/48

[58] Field of Search ..... 173/48, 13, 104, 109

[56] References Cited

U.S. PATENT DOCUMENTS

| | | | |
|---|---|---|---|
| 3,511,321 | 5/1970 | Schnettler | 173/48 |
| 3,809,168 | 5/1974 | Fromm | 173/48 |
| 3,867,988 | 2/1975 | Koehler | 173/48 |
| 3,998,278 | 12/1976 | Stiltz et al. | 173/48 |
| 4,229,981 | 10/1980 | Macky | 173/48 |
| 4,274,304 | 6/1981 | Curtiss | 173/48 |

*Primary Examiner*—Scott A. Smith

*Attorney, Agent, or Firm*—Charles E. Baxley

[57] ABSTRACT

A driving tool includes a shaft driven by a motor, a barrel rotatably engaged on the shaft, a disc received in the barrel, a number of recesses formed in the disc, a sleeve fixed on the shaft and having a number of teeth for engaging with the recesses of the disc, and a separator received in the disc and movable toward and away from the barrel, the teeth of the sleeve are disengaged from the recesses of the disc when the separator moves away from the barrel, and are engageable with the recesses when the separator moves toward the barrel, such that the shaft can be moved in a striking way and in a reciprocating action.

1 Claim, 5 Drawing Sheets

MOTORIZED DRIVING TOOL

BACKGROUND OF THE INVENTION

1. Field of the Invention

The present invention relates to a driving tool, and more particularly to a motorized driving tool.

2. Description of the Prior Art

A typical motorized driving tool is shown in FIG. 1 and comprises a shaft 10 driven by a motor 11 which has a spindle extended through a cylinder 12, a screw driver or a socket is engaged to the shaft 10 for driving a fastener such as screw, bolt, nut . . . etc. In order to drive different fasteners, it is required to adjust the torque of the driving tool in some cases, therefore, a cap 13 is rotatably engaged on the cylinder 12 and includes one or more protrusions 130 each having an inclined engaging surface 131, a washer 14, a spring 15, a ring 16 and a number of balls 17 engaged between the cap 13 and the cylinder 12, the washer 14 includes a number of projections 140 extended radially outward for engaging with the engaging surfaces 131 of the protrusions 130 such that the spring 15 can be forced or released by the washer 14 when the cap 13 is rotated. However, when such a driving tool is used for drilling holes in concrete object, the torque of the motor 11 is not enough for driving the shaft 10.

The present invention has arisen to mitigate and/or obviate the afore-described disadvantages of the conventional motorized driving tools.

SUMMARY OF THE INVENTION

The primary objective of the present invention is to provide a motorized driving tool which may drive a tool in a striking manner and in a reciprocating way in order to work with concrete objects.

In accordance with one aspect of the invention, there is provided a driving tool comprising a cylinder, a motor, a shaft including a first end slidably engage in the cylinder and secured to the motor so as to be driven by the motor, and including a second end extended outward of the cylinder, a barrel rotatably engaged on the shaft and including at least one cavity formed therein, a disc received in the barrel and secured to the cylinder, and including a number of recesses and a bore formed therein, a sleeve fixed on the shaft and rotated in concert with the shaft, and including at least one tooth for engaging with the recesses of the disc, a separator slidably received in the bore of the disc and engaged with the sleeve, and including at least one projection extended therefrom for engaging with the cavity of the barrel, the tooth of the sleeve being disengaged from the recesses of the disc when the projection is disengaged from the cavity, and the tooth being engageable with the recesses when the projection is engaged with the cavity, and means for biasing the separator away from the sleeve, whereby, the sleeve and the shaft are moved in a striking way and in a reciprocating action when the sleeve and the shaft are rotated relative to the disc and when the projection is engaged with the cavity.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
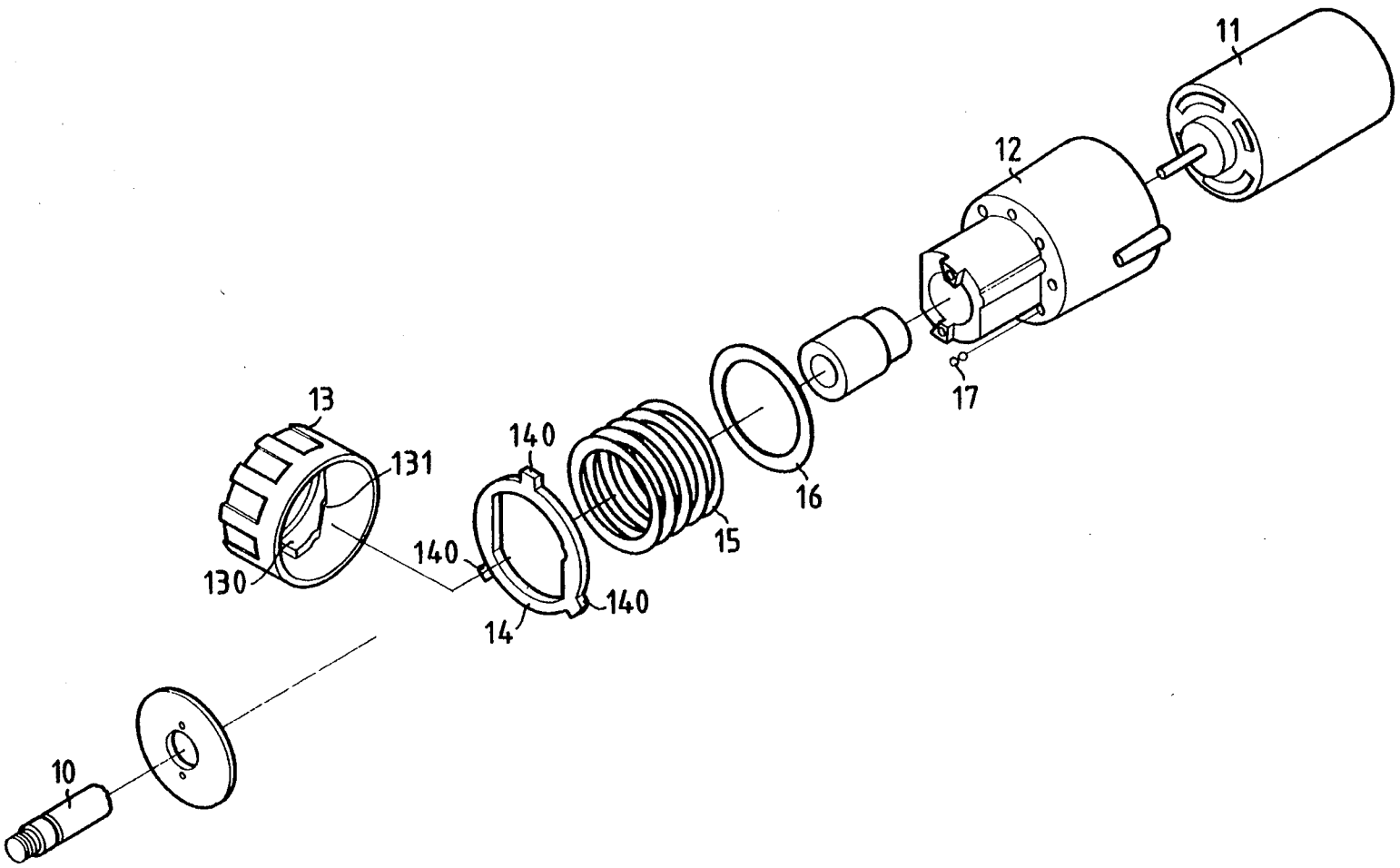
FIG. 1 PRIOR ART
FIG. 1 is an exploded view of a typical motorized driving tool.
Figure 2:
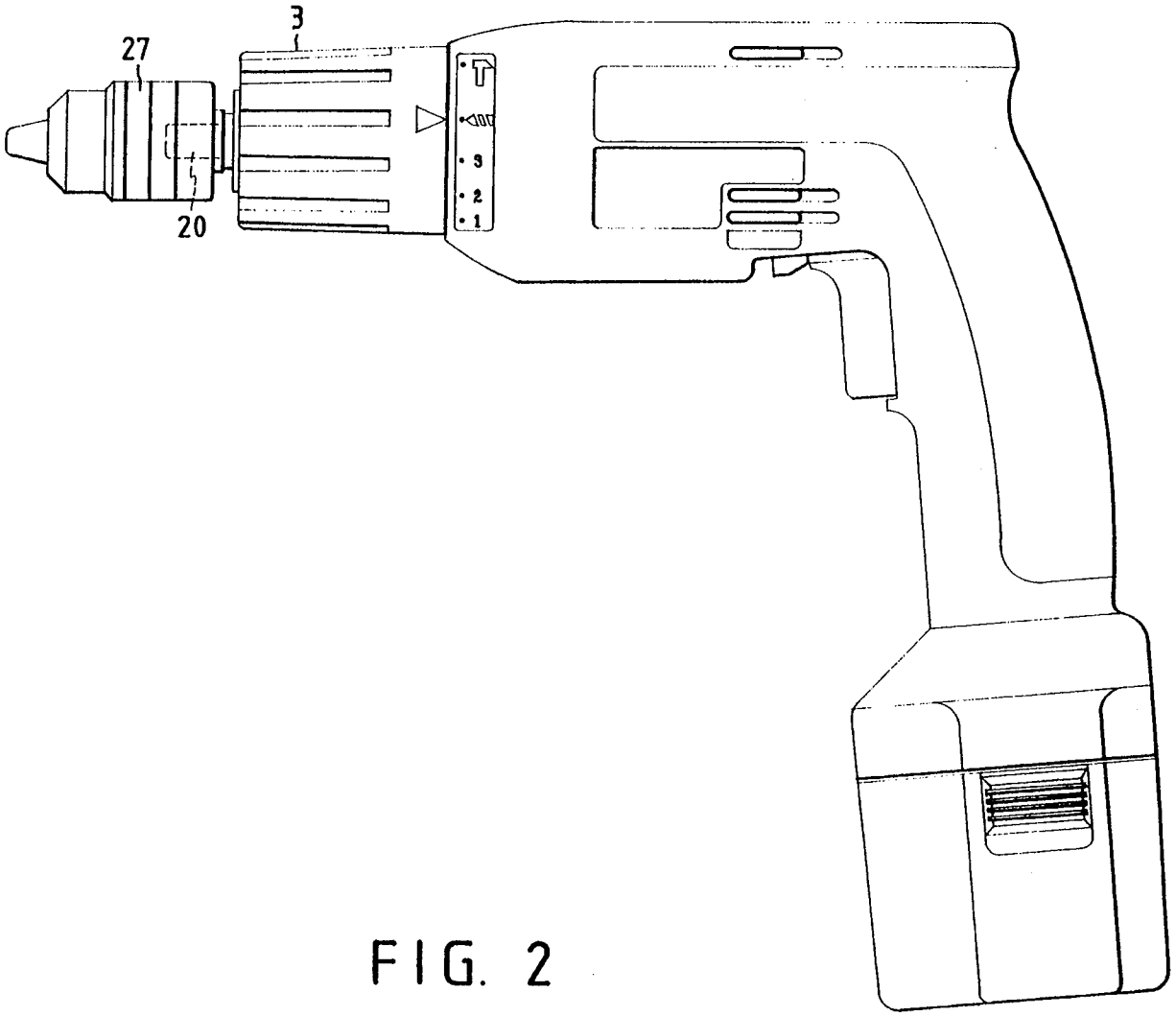
FIG. 2 is a plane view of a motorized driving tool in accordance with the present invention.
Figure 3:
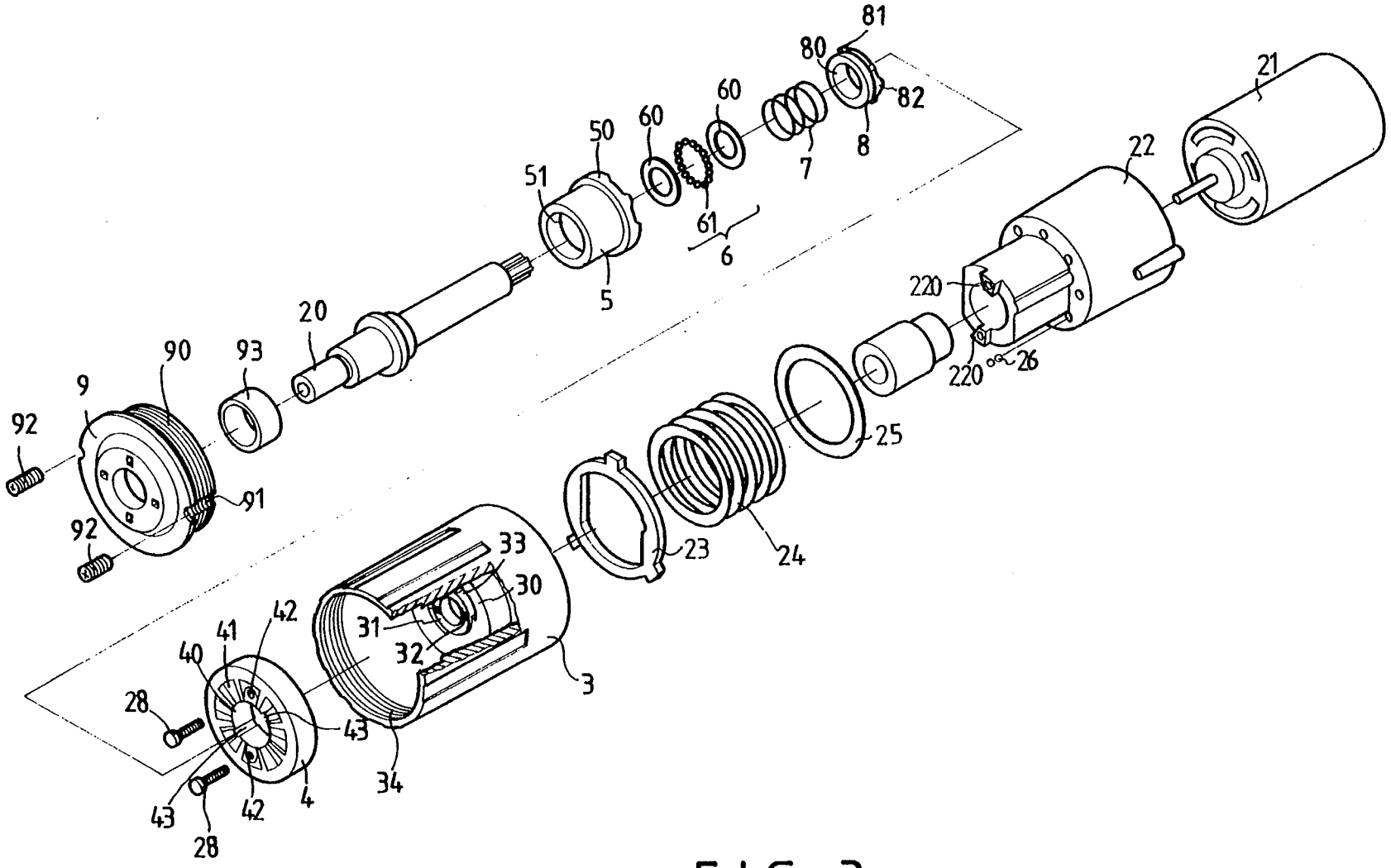
FIG. 3 is an exploded view of the motorized driving tool.
Figure 4:
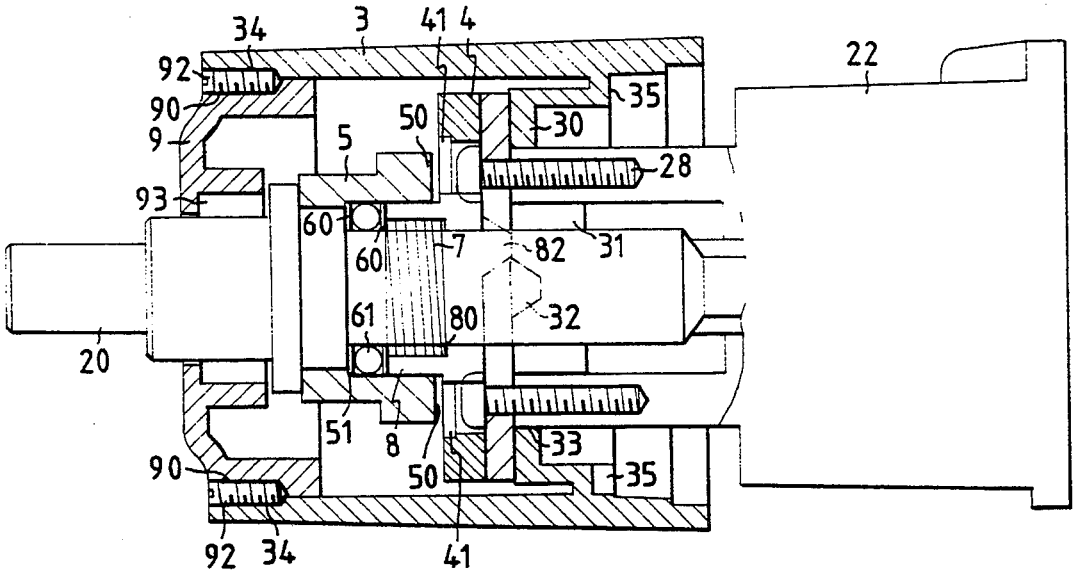
FIG. 4 is a cross sectional view of the motorized driving tool.
Figure 5:
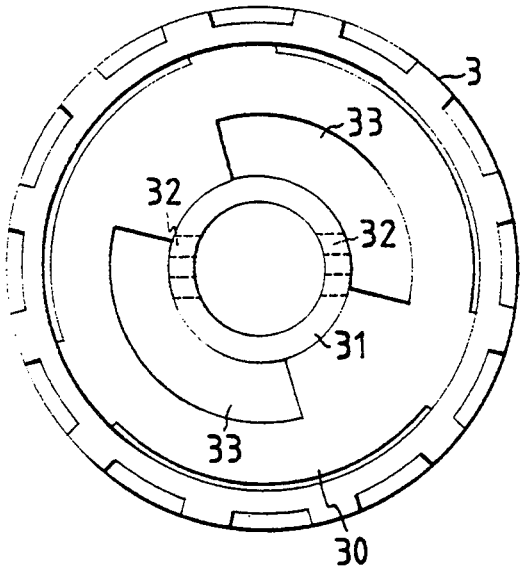
FIG. 5 is a front elevational view of the cap.

Referring to FIGS. 2 to 4, a motorized driving tool in accordance with the present invention comprises a shaft 20 secured to a motor 21 and driven by the motor 21 which is engaged in a cylinder 22, a barrel 3 rotatably engaged on the cylinder 22, a washer 23, a spring 24, a ring 25 and a number of balls 26 engaged between the barrel 3 and the cylinder 22 for adjusting the torque of the driving tool, the above-described configuration is similar to the typical motorized driving tool and will not be described in further details.

The cylinder 22 is fixed in the driving tool and includes two screw holes 220 formed therein, the shaft 20 is rotatably and slidably engaged in the cylinder 22, the barrel 3 includes a rear surface having a protrusion 35 extended therefrom, an inclined engaging surface formed in the protrusion 35 for engaging with the washer 23 so as to actuate the spring 24, an annular flange 30 extended radially inward from the barrel 3, a hub 31 provided in the center of the annular flange 30 for receiving with the shaft 20, the hub 31 including a front surface having a pair of cavities 32 formed therein, a pair of depressions 33 of sector shape are formed in the outer peripheral portion of the hub 31. A disc 4 is received in the barrel 3 and engaged with the annular flange 30 of the barrel 3 and includes a front surface having a number of recesses 41 formed therein and having two apertures 42 formed therein, two screws 28 engaged through the apertures 42 and the depressions 33 and engaged with the screw holes 220 of the cylinder 22 so as to fix the disc 4 to the cylinder 22, the disc 4 includes a bore 40 having two slots 43 formed therein.

A sleeve 5 is fixed on the shaft 20 and rotated in concert with the shaft 20, and includes an annular shoulder 51 formed in the inner peripheral surface thereof for engaging with a bearing 6 which is fixed between the sleeve 5 and the shaft 20 and includes a number of balls 61 retained between two rings 60, the sleeve 5 further includes a number of teeth 50 formed thereon for engaging with the recesses 41 of the disc 4. A separator 8 is rotatably engaged on the shaft 20 and engaged with the bearing 6 such that the separator 8 is freely rotatable relative to the sleeve 5 and the shaft 20 includes a pair of ears 81 extended radially outward for slidably engaging with the slots 43 of the disc 4 such that the separator 8 will not rotate relative to the disc 4 and is slidable in the disc 4, the separator 8 includes a pair of projections 82 extended therefrom for engaging with the cavities 32 of the barrel 3 when the projections 82 are aligned with the cavities 32, and a spring 7 biased between the shoulder 80 of the separator 8 and the bearing 6. It is to be noted that the teeth 50 of the sleeve 5 is disengaged from the recesses 41 of the disc 4 when the sleeve 5 is moved away from the disc 4 by the separator 8 and when the projections 82 are not engaged with the cavities 32, best shown in FIG. 4.

The barrel 3 further includes an inner thread 34 formed in the front portion of the inner peripheral surface thereof, a cap 9 includes an outer thread 90 for engaging with the inner thread 34 of the barrel 3, the cap 9 further includes two halves of screw holes 91, and two screws 92 engaged with the screw holes 91 and the inner thread 34 of the barrel 3 so as to solidly fix the cap 9 to the barrel 3, and a spacer 93 is engaged between the cap 9 and the barrel 20.

In operation, as shown in FIG. 4, the sleeve 5 is moved away from the disc 4 by the separator 8 when the projections 82 are not engaged with the cavities 32, at this moment, the teeth 50 are not engaged with the recesses 41 of the disc 4, and the shaft 20 can still be rotated and driven by the motor 21, however, the shaft 20 can not be driven in a striking manner and in a reciprocating action.

Figure 6:
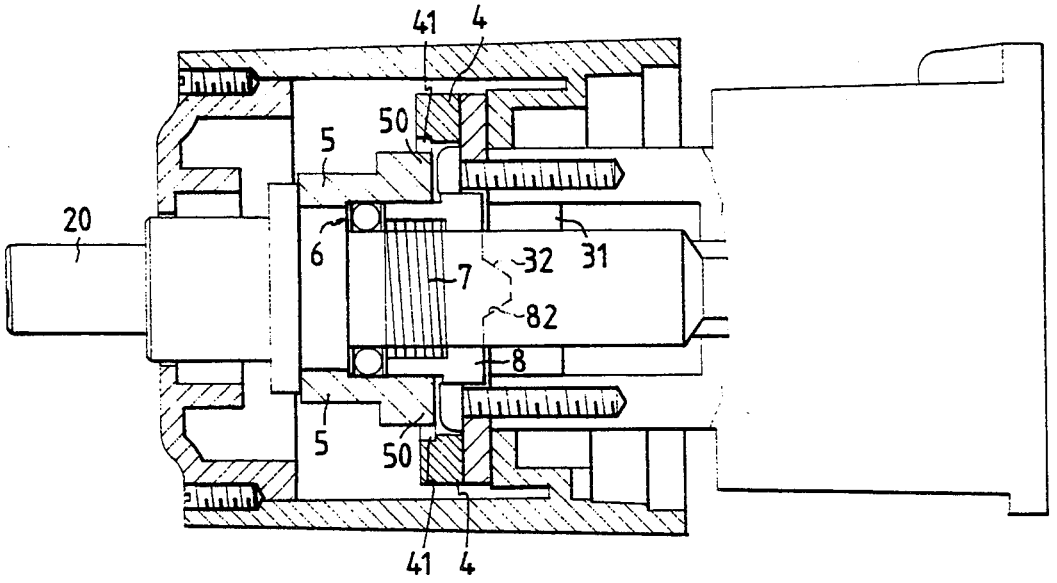
FIG. 6 is a cross sectional view illustrating the operation of the motorized driving tool.

As shown in FIG. 6, when the barrel 3 is rotated until the cavities 32 are aligned with the projections 82, the projections 82 can be engaged with the cavities 32 such that the sleeve 5 may move toward the disc 4 and such that the teeth 50 of the sleeve 5 may engage with the recesses 41 of the disc 4; when the teeth 50 of the sleeve are engaged with the recesses 41 of the disc 4 and when the sleeve 5 is rotated relative to the shaft 20, the sleeve 5 and the shaft 20 are caused to move away from the disc 4 and toward the disc 4 in a striking way and in a reciprocating action such that the driving tool can be operated in a striking way, whereby, the driving tool can be used to drill hard object or to drill concrete walls.

Accordingly, the motorized driving tool in accordance with the present invention may be operated in a striking manner and in a reciprocating way in order to work with concrete objects.

Although this invention has been described with a certain degree of particularity, it is to be understood that the present disclosure has been made by way of example only and that numerous changes in the detailed construction and the combination and arrangement of parts may be resorted to without departing from the scope of the invention as hereinafter claimed.

I claim:

1. A driving tool comprising:

a cylinder;

a motor;

a shaft slidably engaged in said cylinder and secured to said motor so as to be driven by said motor;

a barrel rotatably engaged on said shaft and including at least one cavity formed therein;

a disc received in said barrel and secured to said cylinder, and including a plurality of recesses and a bore formed therein;

a sleeve fixed on said shaft and rotated in concert with said shaft, and including at least one tooth for engaging with said recesses of said disc;

a separator slidably received in said bore of said disc and engaged with said sleeve, and including at least one projection extended therefrom for engaging with said at least one cavity of said barrel, said at least one tooth of said sleeve being disengaged from said recesses of said disc when said at least one projection is disengaged from said at least one cavity, and said at least one tooth being engageable with said recesses when said at least one projection is engaged with said at least one cavity; and means for biasing said separator away from said sleeve;

whereby, said sleeve and said shaft are moved in a striking way and in a reciprocating action when said sleeve and said shaft are rotated relative to said disc and when said at least one projection is engaged with said at least one cavity.

* * * * *